US007905222B1

(12) United States Patent
Fenley

(10) Patent No.: US 7,905,222 B1
(45) Date of Patent: Mar. 15, 2011

(54) FOOTBALL THROWING MACHINE

(76) Inventor: Edward Anthony Fenley, Ashburn, VA (US)

( * ) Notice: Subject to any disclaimer, the term of this patent is extended or adjusted under 35 U.S.C. 154(b) by 551 days.

(21) Appl. No.: 11/968,192

(22) Filed: Jan. 1, 2008

(51) Int. Cl.
*F41B 7/00* (2006.01)

(52) U.S. Cl. ..... 124/16; 124/37

(58) Field of Classification Search ..... 124/16, 124/26, 27, 29, 37, 38
See application file for complete search history.

(56) References Cited

U.S. PATENT DOCUMENTS

| | | | | |
|---|---|---|---|---|
| 3,128,753 | A | 4/1964 | Politzer | |
| 3,807,379 | A | 4/1974 | Vodinh | |
| 3,926,170 | A | 12/1975 | Dixon | |
| 3,951,125 | A | 4/1976 | Dixon | |
| 3,977,386 | A | 8/1976 | Meyer | |
| 4,026,261 | A | 5/1977 | Paulson et al. | |
| 4,261,319 | A | 4/1981 | Dixon | |
| 4,579,100 | A | 4/1986 | Whitaker | |
| 4,596,230 | A | 6/1986 | Griffith | |
| 4,723,532 | A | 2/1988 | Osojnak | |
| 5,224,701 | A | 7/1993 | Sciarrillo et al. | |
| 5,447,144 | A | 9/1995 | Ivy | |
| 5,597,160 | A * | 1/1997 | Mims | 124/16 |
| 5,769,064 | A | 6/1998 | Lu et al. | |
| 6,637,422 | B2 | 10/2003 | Wojtkiewicz et al. | |
| 6,679,239 | B1 | 1/2004 | Shultz | |
| 6,718,961 | B1 | 4/2004 | Woods et al. | |
| 7,028,682 | B1 * | 4/2006 | Hansen | 124/16 |
| 7,125,349 | B2 | 10/2006 | Tucker | |

OTHER PUBLICATIONS

Sport-Fun, Inc., Deluxe Mr. Quarterback Football Passing Machine Owners Manual, Item #1343, 2004, pp. 1-4, Los Angeles, CA 90039, U.S.A. Available at http://www.sportfun.com/webpage/CSI/instructions/radio%20control%20machines/Mr.%20Quarterback/MR%20Q%201.pdf.

* cited by examiner

*Primary Examiner* — John Ricci

(57) ABSTRACT

One embodiment of a football throwing machine using an axially aligned compression spring for propulsion and a latching mechanism for retaining the spring in its compressed state. A spiral shaped actuator mechanism is used to compress the spring with consistent torque throughout the compression stroke. The spring is released from its compressed state using an efficient triggering mechanism. A timing mechanism allows a delay so the user can position for the catch. The football is held by axially misaligned wheels on one end and a rotating cup on the other. As the spring pushes the ball between the wheels while being ejected from the apparatus, the wheel misalignment causes the helical spinning effect on the football while the cup holding the other end of the football spins freely.

20 Claims, 12 Drawing Sheets

FOOTBALL THROWING MACHINE

CROSS-REFERENCE TO RELATED APPLICATIONS

None

FEDERALLY SPONSORED RESEARCH

Not Applicable

SEQUENCY LISTING OR PROGRAM

Not Applicable

BACKGROUND

1. Field of the Invention

This invention relates to a machine designed to repeatedly and accurately throw a football shaped object for catching practice, without the required assistance of a second person.

2. Prior Art

There have been numerous attempts to produce equipment capable of achieving repeatable, accurate football throws for use in catching practice. Designs by Dixon (U.S. Pat. Nos. 3,926,170, 3,951,125) and Meyer (U.S. Pat. No. 3,977,386) employed vertical and horizontal cantilever arms to simulate the arm motion of a quarterback. Centrifugal force and friction imparted the spinning effect required for stability during the ball flight. While these techniques may produce a throw, the equipment is large, bulky and can require significant effort to operate. Additionally, the ball spin that is required is imparted only indirectly as the ball rolls off of the carriage. This method is unlikely to produce the accuracy and consistency required for practical use.

Subsequently Paulson (U.S. Pat. No. 4,026,261) addressed the problem using a design with coacting or counter-rotating wheels powered by an electric motor to grip and fling the ball as it passes between the wheels. The wheels are slightly misaligned with one another, thus creating the spin required for a steady flight. This design likely produced more consistent flight characteristics and directly imparts the required spin on the ball. The disadvantages of this design include the large size and weight, the high cost of components and the requirement for high voltage alternating current power, which is frequently unavailable on a practice field. Also, the equipment did not have a method of throwing a ball to oneself, as an operator is required to aim and feed the ball into the equipment.

Several designs incorporate rubber bands as the means of propulsion. One method used large elastic bands as a slingshot (Dixon, U.S. Pat. No. 4,261,319) whereby the band is twisted to provide the ball spin at release. This design includes a timer for one person operation; however this design has the disadvantage of requiring a special football with a hole through the center. Adjustments to the throw distance, pulling back the elastic bands, and loading the football, all appear to be somewhat cumbersome. One other elastic band design for a shoulder launched mechanism (Ivy, U.S. Pat. No. 5,447,144) uses multiple elastic bands to provide propulsion to the ball. This design utilizes a torsion spring mechanism to impart spin to the ball at the end of the release stroke. Disadvantages of this design include the complexity of the assembly, likely high cost, and likelihood of being very cumbersome in practical use.

One design used an air cylinder and compressed air to propel a football (Sciarrillo, U.S. Pat. No. 5,224,701). This design uses the rapid extension of a pneumatic cylinder to provide propulsion. Spin is provided by mounting the inner shaft on a nut that spins down a rifled cage as the cylinder extends. The end of the shaft is contoured to contact the football which theoretically would spin along with it due to contact pressure. Disadvantages to this design are the size, weight and complexity of the equipment as well as the availability and expense of delivering high voltage power or compressed air to the place of use.

An additional pneumatic design (Sportfun—Mr. Quarterback Operation Manual, 2004) uses compressed air to launch a hollow plastic football from a portable launcher. This device is battery powered and portable, but has the disadvantage of requiring a custom, non regulation football and can best be described as a toy for children. It has a delay mechanism, however the timing varies only to the degree that the equipment requires more time to generate higher pressures for longer throws. Another toy design uses a motor and a rotating wheel to feed and propel a ball, however the patent clearly states the intent is for the toy market (Wojtkiewicz, U.S. Pat. No. 6,637,422).

Other inventors have added to the mechanisms for automatically feeding of balls into existing equipment (Osojnak, U.S. Pat. No. 4,723,532; Griffith, U.S. Pat. No. 4,596,230) as well as remotely controlling the release of a ball (Shultz et al., U.S. Pat. No. 6,679,239). These inventions are mentioned only to demonstrate the ongoing interest in equipment designed for the purpose of throwing footballs.

SUMMARY

An effective training device for football catching practice will have many desirable characteristics. It must replicate a manually thrown football as closely as possible, while providing consistency and accuracy so a specific catch can be repeated as many times as necessary. The football should have a repeatable helical spin as it travels so as to steady the ball in flight. The equipment should have a mechanism for delaying the release of the football so the user can position to catch the football when it arrives at its destination. In this way the trainee can duplicate the run patterns used in a football game, repeating each run and receipt in exactly the same fashion. Additional desirable characteristics of this training equipment include portability and low power consumption. Equipment should be mobile enough to be easily transported to a practice field and should operate on inexpensive, portable power while in use. It should also be lightweight and simple enough to setup and operate so that users of less than adult size and strength can make use of the equipment.

This invention addresses these requirements by matching efficient spring power with mechanical leverage to allow the user to provide the propulsion energy required for throwing the football. An efficient triggering mechanism allows the equipment timing and triggering actions to be completed using only battery power. The helical spin is directly and efficiently achieved by passing the football through a set of freely spinning wheels that are angled to apply the rotational force required to achieve the spin on the football. The result is portable, inexpensive, easy to use equipment for accurately and repeatedly throwing footballs.

DRAWINGS

Figures

In the drawings, closely related figures have the same number but different alphabetic suffixes.

FIG. 1 is a side view of one embodiment of the invention showing the basic operation.

FIG. 2*a* is a football shown held in a pre-launch position in one embodiment of this invention.

FIG. 2*b* is the football being ejected from that embodiment with the helical spiral motion required.

Figure 5A:
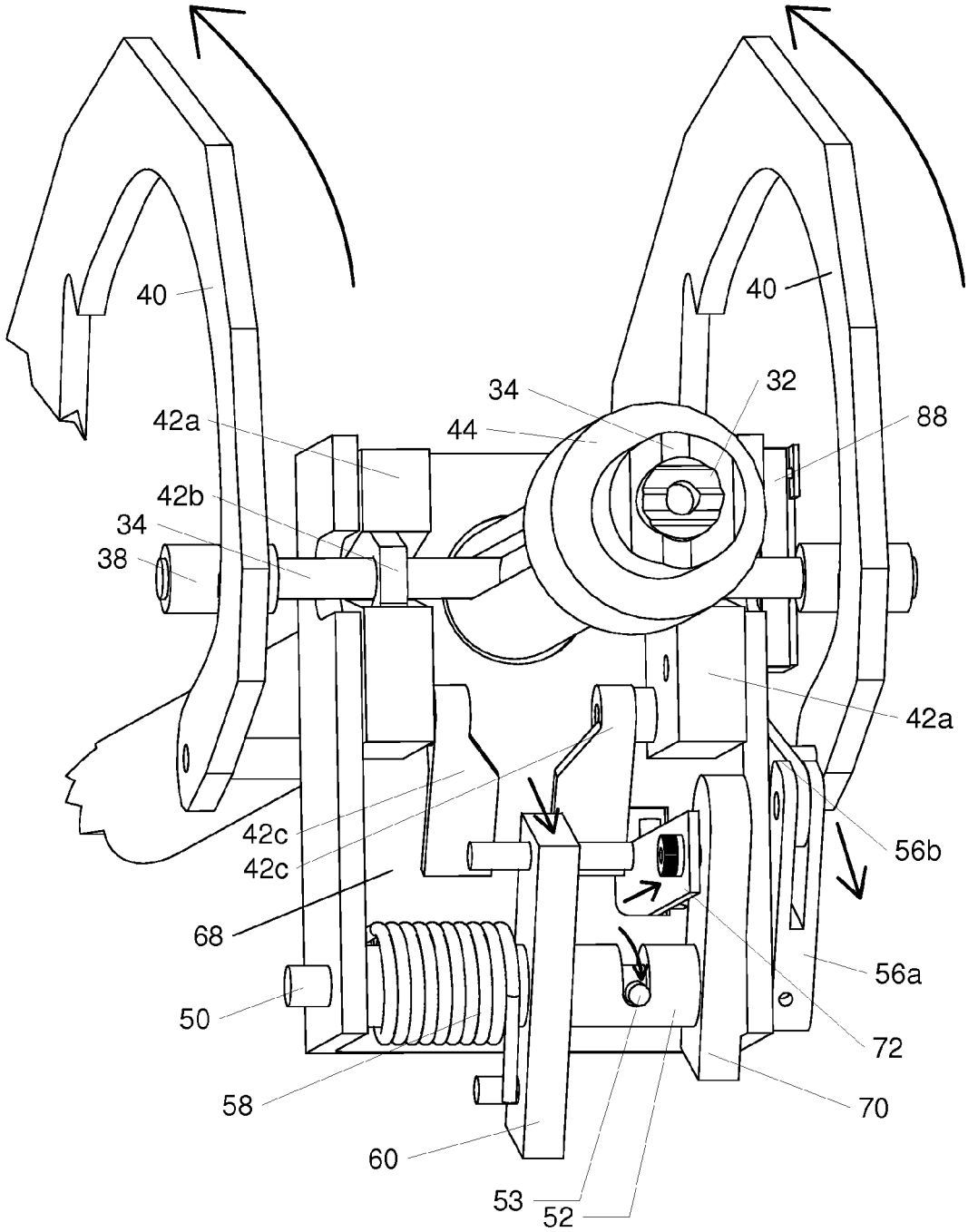

FIG. 5*a* is a view from the front, under and inside, showing one embodiment of a latching mechanism at the end of the spring compression stroke.

Figure 5B:
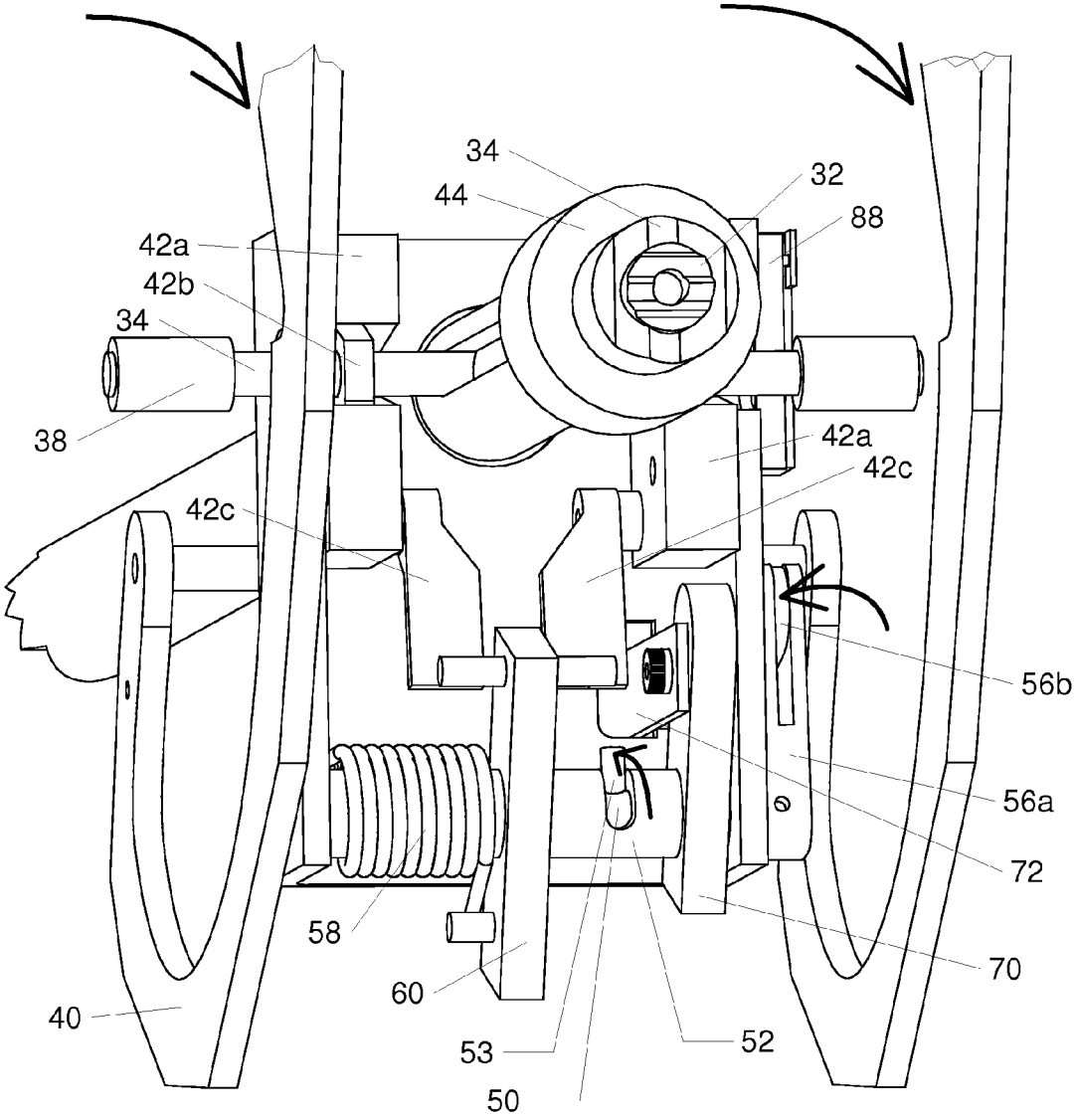

FIG. 5*b* is a view from the front, under and inside, showing one embodiment of a latching mechanism after returning the handle to its original position but before releasing the football.

Figure 5C:
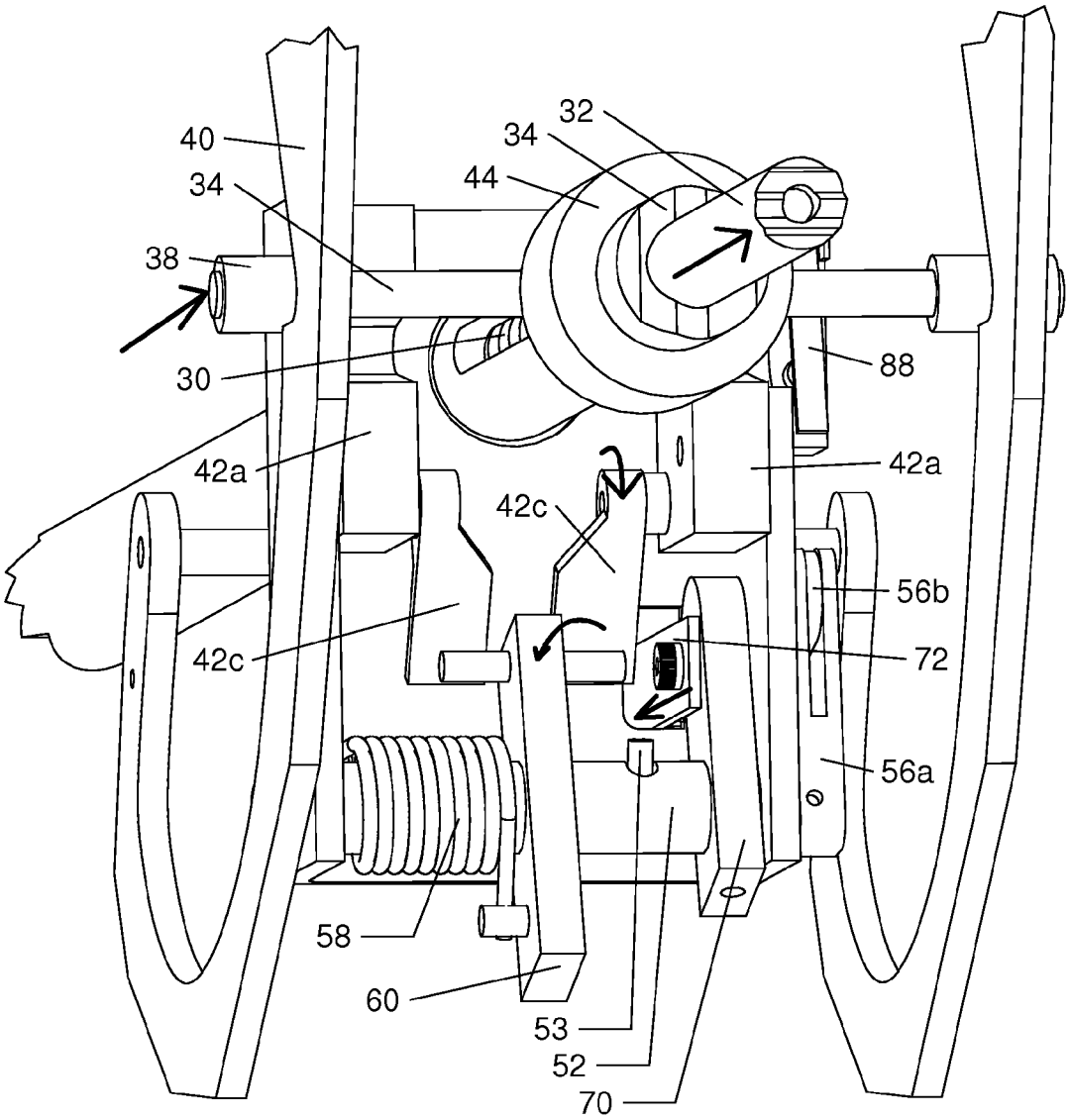

FIG. 5*c* is a view from the front, under and inside, showing one embodiment of the latching mechanism after releasing the football.

Figure 6:
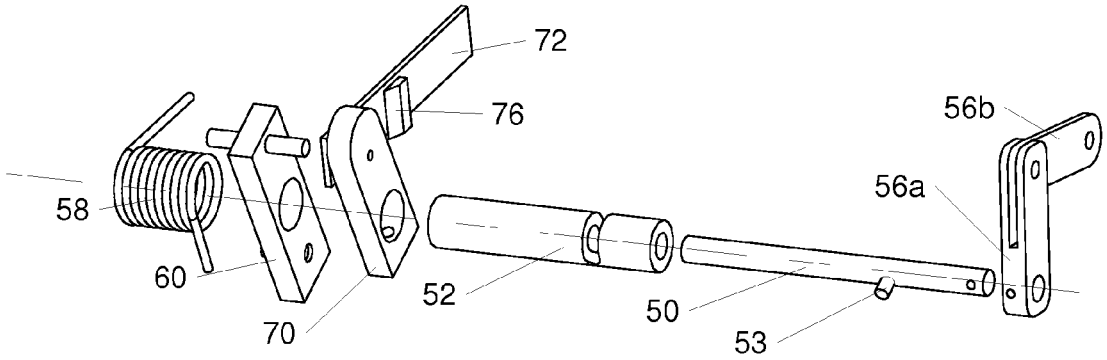

FIG. 6 is an exploded view of some of the components of one embodiment of a triggering mechanism.

Figure 7A:
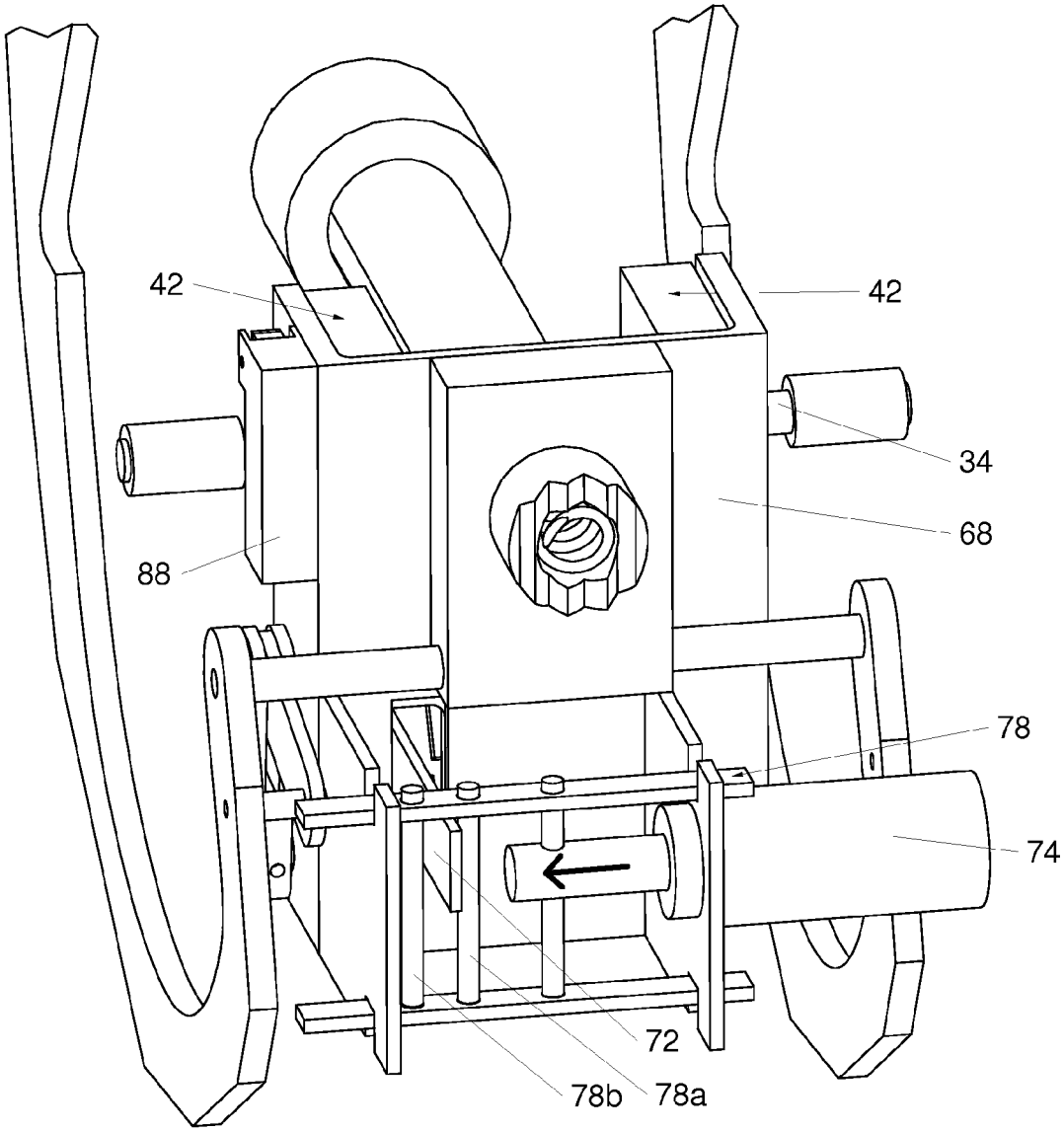

FIG. 7*a* is a view from the rear showing one embodiment of a solenoid mechanism that initiates the triggering sequence when the compression spring is compressed and ready for release.

Figure 7B:
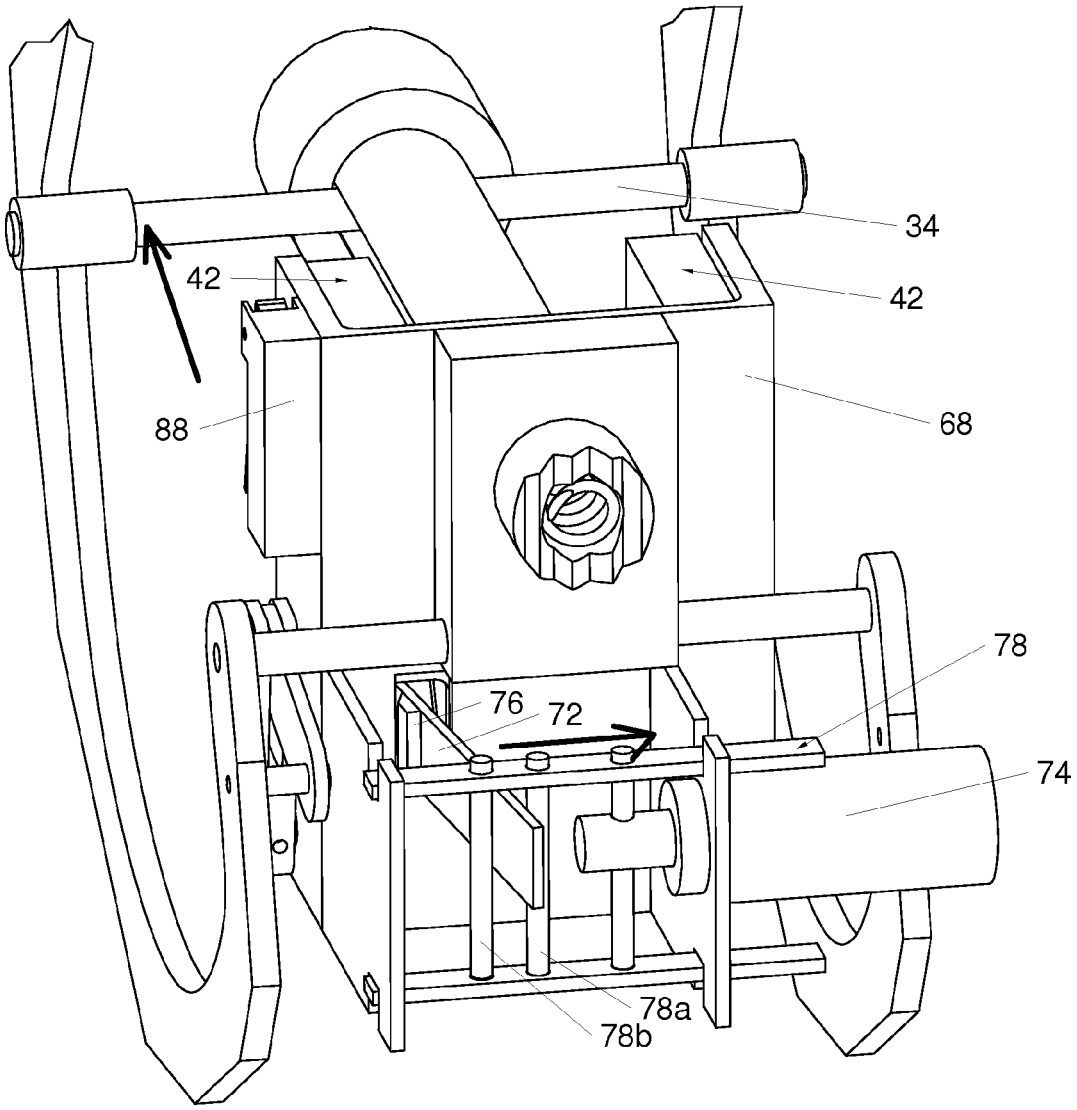

FIG. 7*b* is a view from the rear showing one embodiment of a solenoid mechanism that initiates the triggering sequence immediately after the solenoid is activated.

Figure 8:
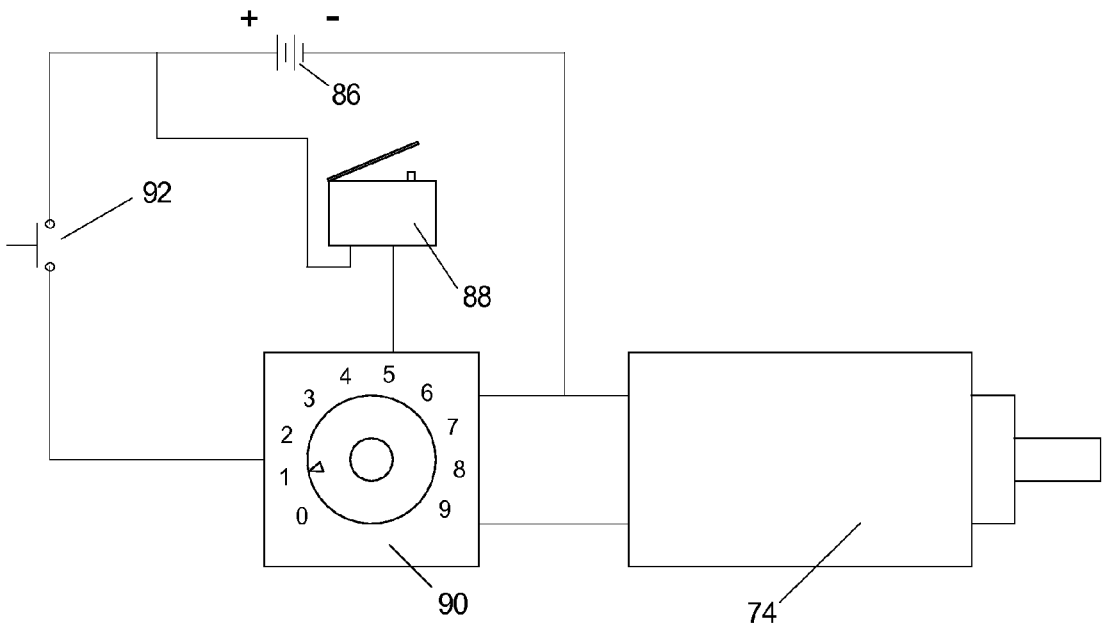

FIG. 8 shows a wiring diagram for one embodiment of the invention.

DETAILED DESCRIPTION

Figure 1:
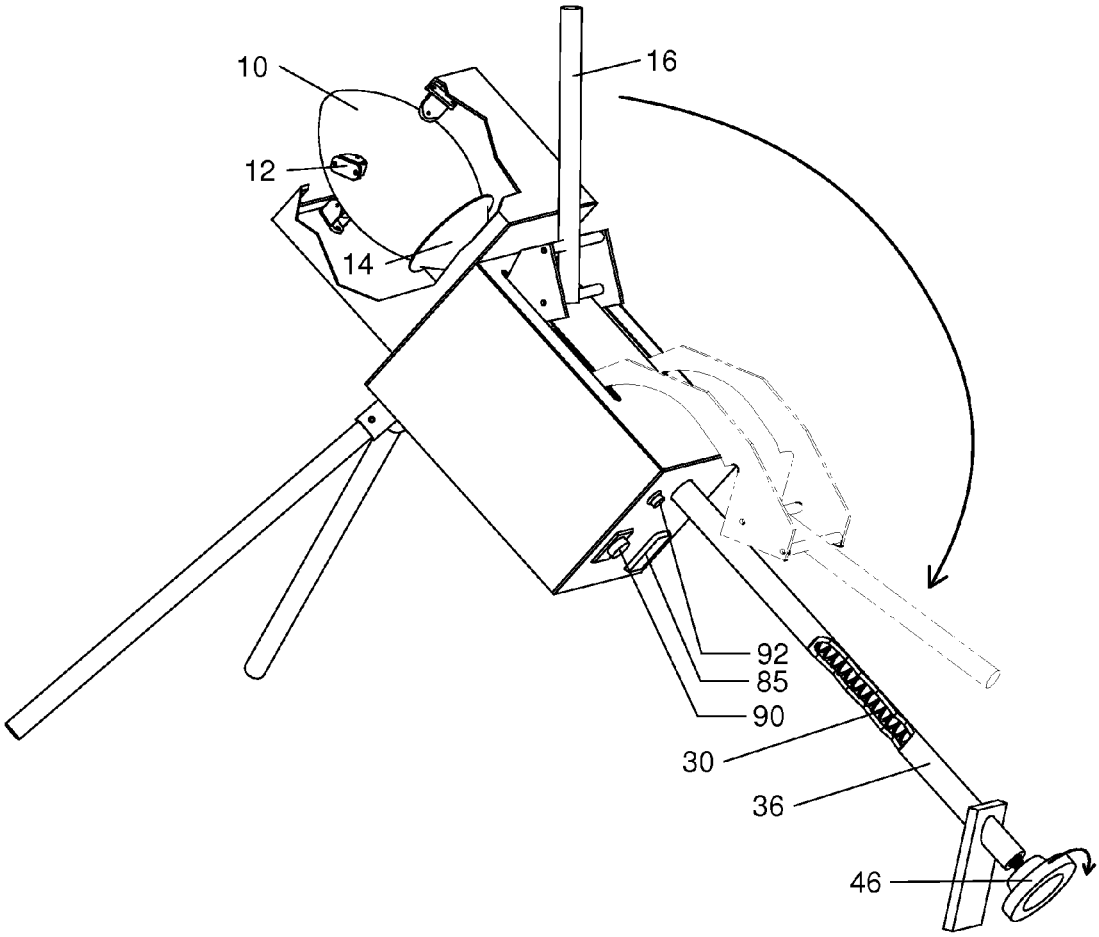

FIG. 1 illustrates one embodiment of this invention showing the basic operation. A spring 30 is enclosed in a tube 36 and positioned so that a football 10 will align along the same axis. The spring 30 is compressed by moving a handle 16 as shown to compress the spring. The handle 16 is returned to its original position prior to launching the football 10. A detailed description of this action is described in FIG. 4. The spring 30 is held in its compressed state by a latching mechanism, one embodiment of which is described in FIGS. 5*a*-5*c*. The football 10 can then be loaded in the front end of the equipment so it rests against a rotating cup 14. The football 10 is held in place radially by several (at least three) free-spinning spin wheels 12 that both hold the football 10 and provide the mechanism for spinning the football 10 upon release. This is described in detail in FIGS. 2*a* and 2*b*. The launch cycle begins by the operator setting a timer 90 for the desired delay and pressing a start button 92 to begin the countdown and subsequent launch. Power is supplied by a battery 86 (not shown) that is located behind a battery cover 85. The distance is controlled by adjusting the pre-compression of the spring 30 by turning a threaded knob 46 clockwise or counterclockwise.

Figure 2A:
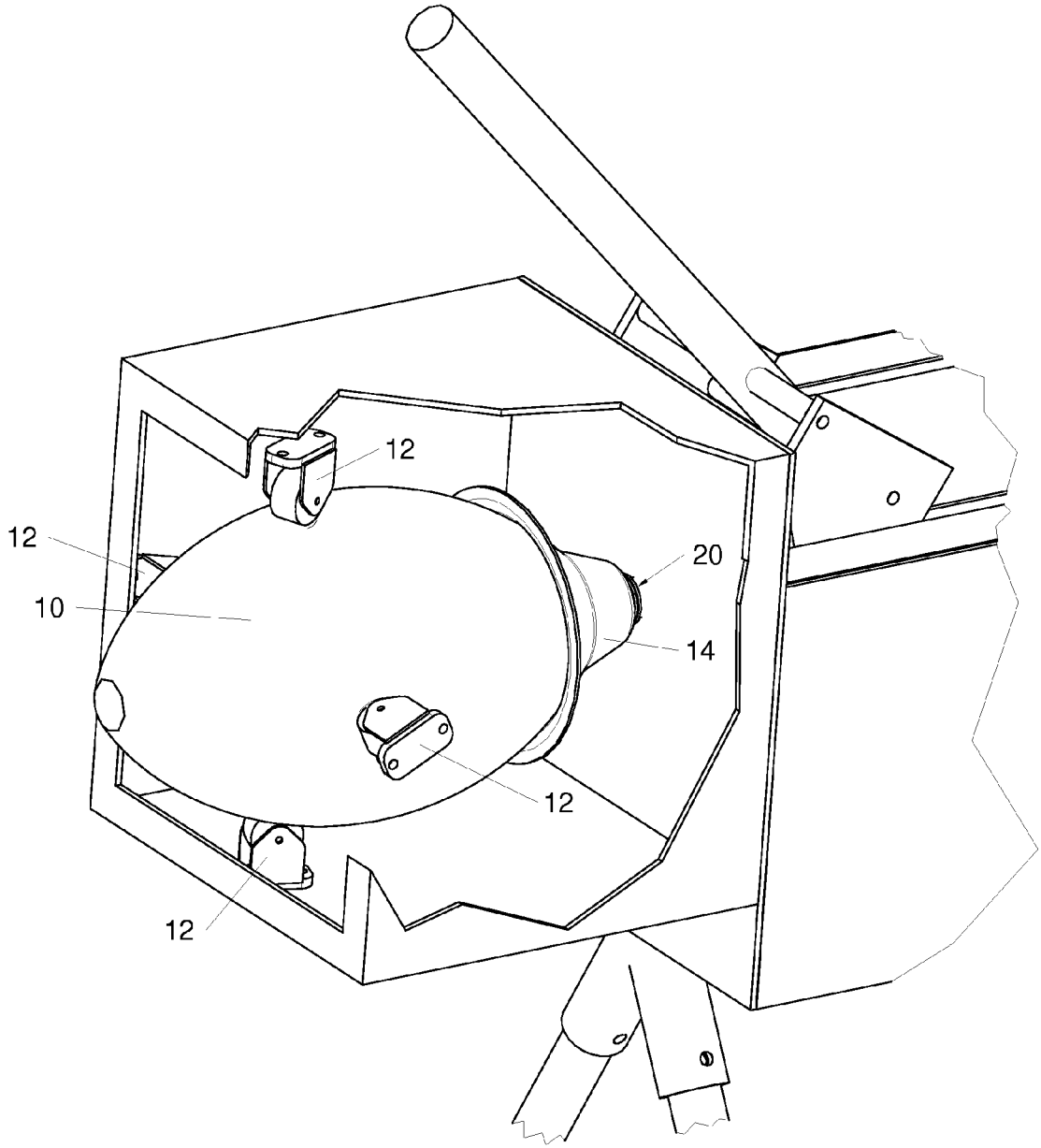
Figure 2B:
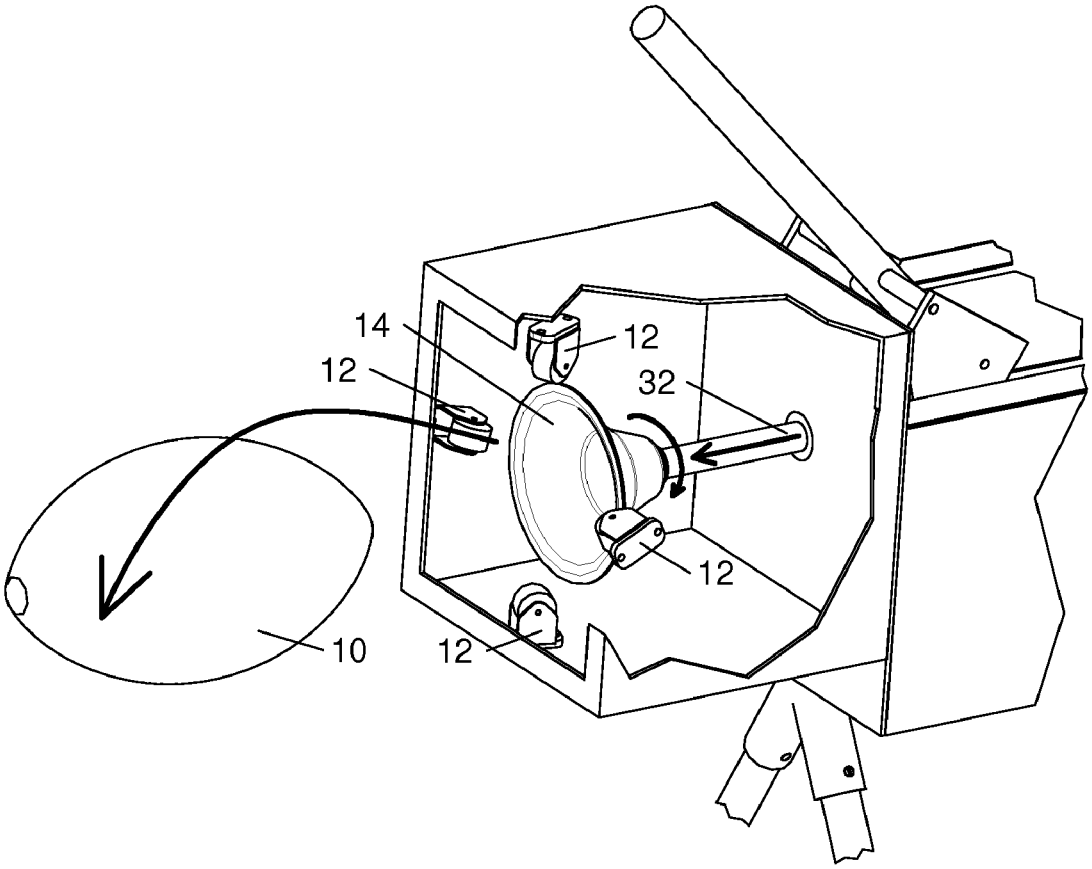

FIG. 2*a* shows the football 10 in its loaded state and FIG. 2*b* shows the football 10 immediately after release. Visible in FIG. 2*a* is the football 10 resting against the cup 14 that contains and aligns the ball with the axis of the spring 30. There are four spin wheels 12 shown in this embodiment and they are positioned to provide a firm squeeze on the football 10. They are located slightly forward of the center of the football 10 to ensure they retain the ball in position prior to launch. Note that these wheels are typically positioned to hold a specific size football (ex. Junior or Youth) and larger or smaller footballs will require the spin wheels 12 be located in slightly different locations, depending on the size ball. The spin wheels 12 are positioned so they are all equally misaligned with the axis of the spring 30 and football 10. As shown in FIG. 2*b*, this angle forces the football 10 into a helical spin on its axis as it is ejected. In this embodiment, the cup 14 that holds the football 10 is mounted with thrust bearings 20 that allow it to freely spin, even while under the axial load caused by the launch movement. This allows the football 10 to follow the helical path dictated by the spin wheels 12. The cup 14 and the bearings 20 are mounted to the end of a piston 32, shown in detail in FIG. 3.

Figure 3:
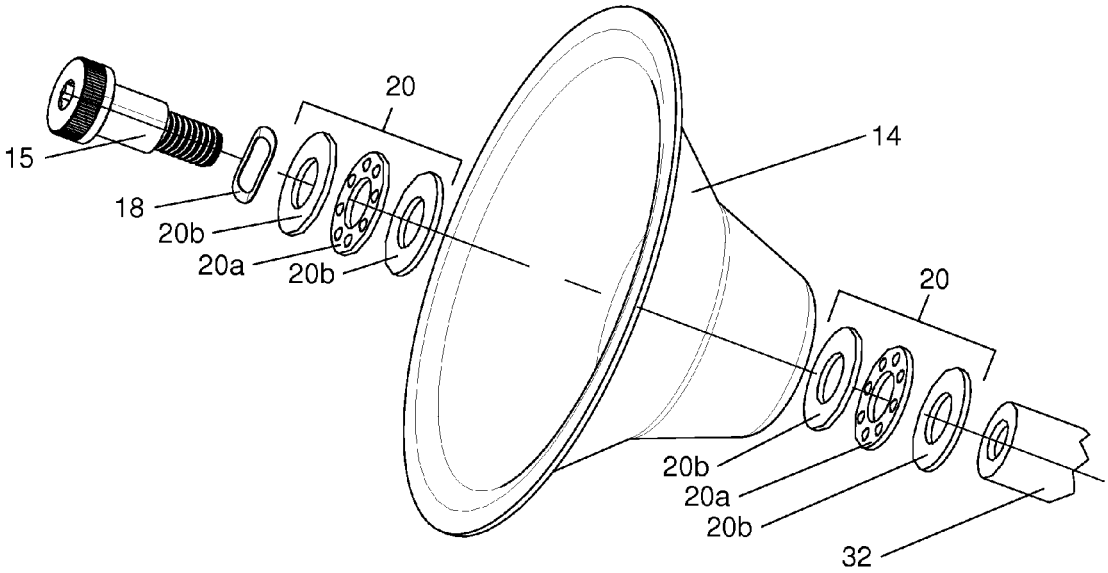
FIG. 3 is a detailed view of one embodiment of a football holding cup and a bearing arrangement that will allow the cup to spin as the ball is released.

FIG. 3 shows a detailed, exploded view of one embodiment of the cup 14 using thrust bearings 20 to allow free rotational motion of the cup 14. The cup 14 is shaped to match the contour of the football 10. The thrust bearing 20 shown is commercially available from many suppliers and consists of a thrust bearing cage 20*a* containing either ball or roller bearings, sandwiched between two thrust washers 20*b*. One bearing 20 is on the inside and one outside of the holding cup 14 and all are held in place using a shoulder bolt 15 that is screwed into the piston 32. The cup 14 spins around the shoulder portion of the shoulder bolt 15. A spring washer 18 applies a consistent force on the assembly to produce a consistent rotation action.

Figure 4:
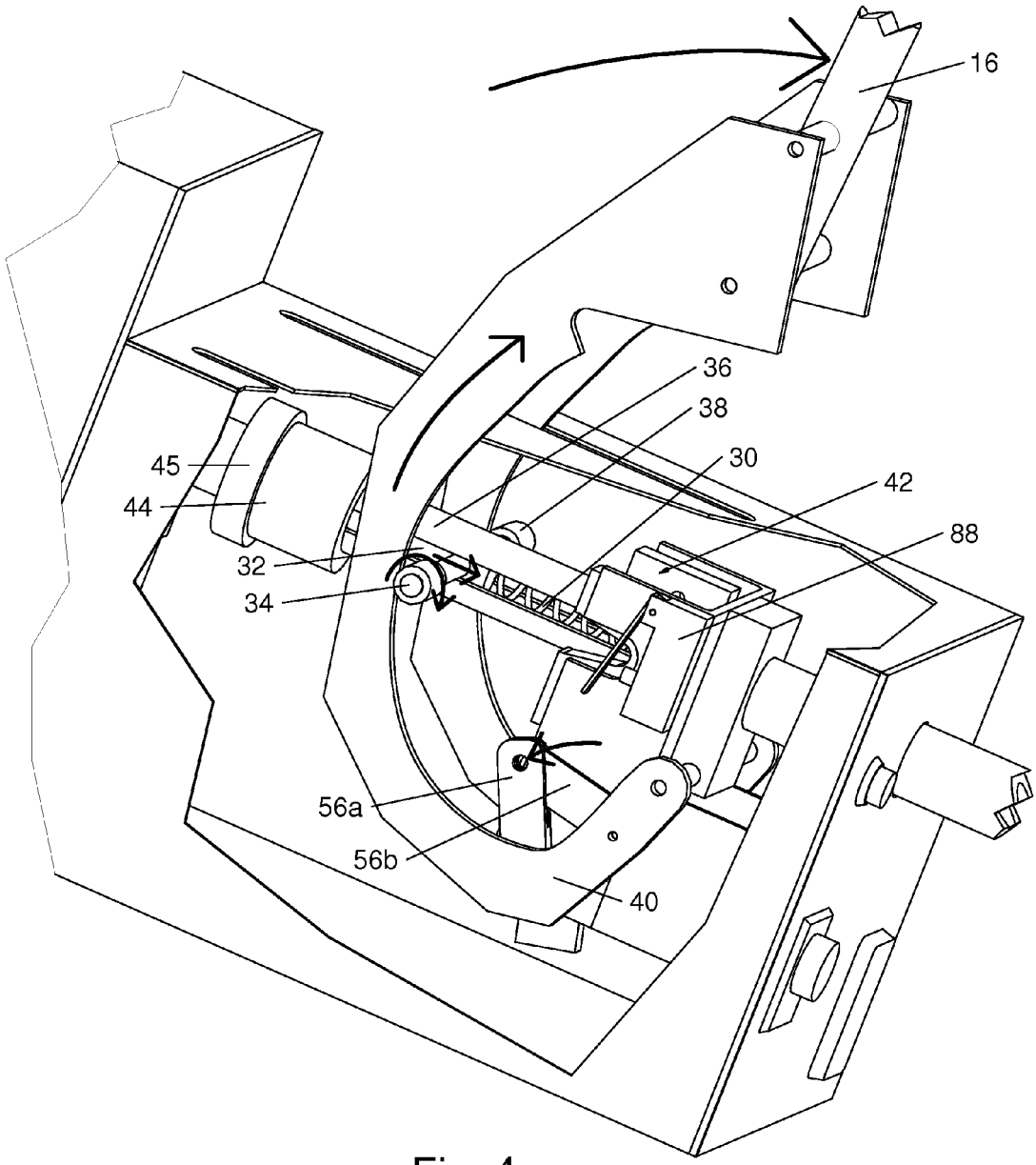
FIG. 4 shows a cutaway side view of one embodiment of a spring compression mechanism.

FIG. 4 is a cutaway view showing the working mechanism responsible for spring compression. As the handle 16 is pulled back and down, a pair of spiral actuators 40 attached to the handle 16 contact a pair of bearings 38 that rotate on a shaft 34. While most elements of this invention can be made of aluminum or mild steel or sometimes plastic, the bearings 38 and shaft 34 are expected to require hardened steel due to the high stress placed on them. The shaft 34 extends through the piston 32 and as it moves, it slides the piston 32 down the tube 36, compressing the spring 30. As the handle 16 progresses through its stroke, the contact point between the spiral actuator 40 and bearing 38 gets closer to the fulcrum point of the spiral actuator 40 motion. This provides incrementally greater mechanical leverage as the handle 16 progresses thru its stroke. The increased leverage acts to offset the increasing force required to compress the spring 30. At the end of the compression stroke, the shaft 34 will be held in place with a rotary latch assembly 42, details of which are described in FIGS. 5*a*-5*c*. While the handle 16 and the spiral actuators 40 progress thru the compression stroke, they also move an upper trigger link 56*b* which is connected to a lower trigger link 56*a* that energizes a triggering mechanism that will be shown in detail in FIGS. 5*a*-5*c* and FIG. 6. As the shaft 34 enters the rotary latch assembly 42, it presses against a microswitch 88 which closes the circuit connecting the battery 86 to the timer 90. A wiring diagram is shown in detail in FIG. 8.

FIGS. 5*a*-5*c* are views from the front, from below, with all exterior covers and adjacent components removed in order to clearly show the latching and triggering mechanism of one embodiment. FIG. 5*a* shows the spiral actuators 40 having compressed the spring 30 so that the shaft 34 is captured in the rotary latch assembly 42. Note that the rotary latch assembly 42 includes a latch body 42*a*, a latch catch 42*b* and a latch release 42*c*. To reach a latched state, the latch catch 42*b* rotates to secure the shaft 34 in the latch body 42*a*. The latch catch 42*b* is released by applying force on the latch release 42*c*. Rotary latches are available from several suppliers and although they all perform a similar function, they may have different internal workings. For this reason, the internal workings of the rotary latch are not described in detail in this specification.

FIG. 5*a* also shows the triggering mechanism being energized by the motion on the upper trigger link 56*b* and the lower trigger link 56*a*. As stated previously, this linkage moves downward when the spiral actuator 40 goes thru its compression motion. The lower trigger link 56*a* is connected to a trigger pin 50 and rotates this pin during the compression stroke. The trigger pin 50 in turn rotates a trigger pall 53 which in turn rotates a trigger sleeve 52. During the spiral actuator 40 return stroke the trigger pall 53 is free to rotate back and does not force any action on the trigger sleeve 52. Attached to the trigger sleeve 52 is a hammer 60 and a trigger release arm 70. Wrapped around the trigger sleeve 52 is a torsion spring 58 that applies torque to the hammer 60, twisting it towards contact with the latch releases 42*c*. The trigger hammer 60 is held in its cocked state by the trigger release arm 70, which is held back by a trigger release bar 72, which in turn is held by a trigger catch 76 (visible in FIG. 6) resting against a latch assembly bracket 68. As it enters the rotary latch assembly 42, the shaft 34 activates the microswitch 88, closing the circuit between the battery 86 and the timer 90. The trigger assembly remains in its cocked state during the return stroke of the handle 16 and the spiral actuators 40. See FIG. 6 for an exploded view of the trigger assembly.

FIG. 5*b* shows the trigger mechanism after the handle 16 and the spiral actuators 40 have been returned to the start position. Note the shaft 34 remains restrained by the rotary latch catch 42*b*. The upper and lower trigger linkages 56*b* and 56*a* return to their original positions, rotating the trigger pin 50 and trigger pall 53 back to their starting positions as well. The hammer 60 and the trigger arm 70 remain in the cocked position.

FIG. 5*c* shows the trigger event immediately after the trigger release bar 72 has been moved out of its secure position, allowing the trigger arm 70 free motion, which allows the hammer 60 to be rotated by the torsion spring 58 into the latch releases 42*c*. This action releases the latch catch 42*b* which in turn releases the shaft 34 allowing the spring 30 to drive the piston 32 forward. The piston 32 stops its motion when the shaft 34 hits a stop bumper 44. The stop bumper 44 slows the piston 32 and dissipates the kinetic energy of the shaft 34, the piston 32 and the spring 30. The stop bumper is held in place on this embodiment using a shaft collar 45 (shown on FIG. 4) located just behind the stop bumper 44. The stop bumper 44 is anticipated to be of a urethane material; however other rubber or plastic materials, a metal spring or even a commercial damper may also be used. The release of the shaft 34 also releases the microswitch 88, creating an open circuit between the battery 86 and the timer 90.

FIG. 6 is an exploded view of one embodiment of a trigger assembly removed from the larger assembly. In it one can view the various components more clearly.

FIGS. 7*a* and 7*b* shows one embodiment of a solenoid release mechanism, viewed from the rear of the equipment, with the external covers removed for clarity. In FIG. 7*a* we see the trigger release bar 72 in its cocked position so that the trigger catch 76 (visible in FIG. 6 and FIG. 7*b*) is resting against the latch assembly bracket 68, thus holding the hammer 60 (shown in FIG. 5*b*) in its cocked position. The solenoid 74 is internally spring loaded to push a solenoid slide assembly 78 towards the trigger release bar 72 when it is not energized. A pin 78*a* presses against the trigger release bar 72 to hold it in a secured position so that the trigger catch 76 (shown in FIG. 7*b*) remains held against the latch assembly bracket 68.

FIG. 7*b* shows the solenoid assembly immediately after activation. Upon receiving an electrical signal, the solenoid 74 pulls the solenoid slide assembly 78 towards it, which in turn causes a pin 78*b* to pull the trigger release bar 72 sideways, sliding the trigger catch 76 off of the latch assembly bracket 68. This allows the release bar 72 to freely move, thus allowing the hammer 60 to swing and activate the latch releases 42*c*, which in turn releases the shaft 34 and the piston 32.

As the shaft 34 exits the rotary latch assembly 42 the microswitch 88 returns to its open position and this action removes power to the timer 90 and the solenoid 74. The loss of power to the solenoid 74 allows the internal spring of the solenoid 74 to push the trigger frame 78 and thus the release bar 72 back against the latch assembly bracket 68, ready for the next equipment cycle.

FIG. 8 demonstrates one embodiment of a wiring diagram for the system. The battery 86 supplies power to the start switch 92 and the microswitch 88. When the microswitch 88 is activated at the completion of the compression stroke, it provides power to the timer 90. The timer shown here is a simple timer commonly used in industry as a process delay timer, however, other timers can be used that perform a similar function. The timer 90 is set to a specific delay period on its face dial and waits for the signal from the start button 92. The start button 92 is momentary and only closes the circuit while being pressed. The timer 90 receives this signal and begins its countdown. At the completion of the countdown, it closes a circuit that provides power from the battery 86, thru the microswitch 88, to the solenoid 74. As the triggering event occurs and the shaft 34 leaves the rotary latch assembly 42, the microswitch 88 returns to an open circuit, removing power to the timer 90 and the solenoid 74.

The materials used in the embodiment described are typically aluminum due to its strength to weigh ratio and resistance to the environment; however other materials such as steel, stainless steel and plastic may be substituted for many of the components. As stated, hardened steel is a likely requirement for the bearings 38 and the shaft 34. The springs (30,58) are to be of steel or stainless steel, and the rotary latches 42 are a combination of hardened and unhardened steel or stainless steel.

As stated previously, this is but one embodiment of this invention and other embodiments will be obvious to those skilled in the art. Other embodiments may include additional features such as safety lockouts to prevent accidental triggering while the handle is in its return stroke or football is being loaded. Audible warnings may be added to ensure people nearby are aware of the current status (loaded/released) of the equipment. These features can be readily added using commercially available limit switches, buzzers and other commercially available components by one skilled in the art.

Operation

The operation of this embodiment of the invention follows a sequence where, after installing or charging the batteries 86, the user pulls the handle 16 (FIG. 1) from its upright position to the downward position, also referred to as the compression stroke. This rotates the spiral actuators 40 (FIG. 2), whose inner surfaces ride against the bearings 38 that spin on shaft 34. As the spiral actuators 40 rotate thru the compression stroke, they drive the shaft 34 back, which drives the piston 32 down tube 36, which compresses the spring 30 until the shaft 34 is securely latched in place in the rotary latch assemblies 42. The spiral shape of the spiral actuators 40 allows increasing leverage to the handle 16 as the force on the spring 30 increases, thus allowing the user to perceive a consistent force requirement on the handle 16. As it enters the rotary latch assembly 42, the shaft 34 presses against the lever of the microswitch 88, which closes the circuit, thus connecting power from the battery 86 to the timer 90.

As the handle 16 moves thru the compression stroke, it also energizes a triggering mechanism as shown in FIG. 5*a*-5*c*. The upper link 56*b* pushes against the lower link 56*a* which rotates the trigger pin 50 so as to cock the hammer 60 back against the torque provided by the torsion spring 58. The hammer 60 is held in the cocked position by the trigger catch 76 which is mounted on the trigger release bar 72 and rests against the latch assembly bracket 68. The trigger release bar 72 is connected to the trigger arm 70 which is secured to the trigger sleeve 52 along with the hammer 60. Details of this assembly are viewable on FIG. 6. At the completion of the compression stroke, the handle 16 is returned to its original position. The trigger release bar 72, trigger arm 70 and hammer 60 remain in a cocked position while the upper 56*b* and lower 56*a* linkages, and the trigger pin 50 return to their original position.

The user then loads the football 10 into the front end of the equipment as shown in FIG. 2*a* so it seats against the cup 14. The spin wheels 12 hold the front end of the football 10 snugly in alignment with the axis of the spring 30 and piston 32. The user can then adjust the distance required by turning threaded knob 46 at the back end of the equipment to adjust the pre-compression on the spring. The user then sets the desired delay time, typically between 1 and 10 seconds, on the timer 90. The user starts the countdown by pressing the start button 92 and then positions themselves for the catch.

Pressing the start button 92 applies momentary contact between the battery 86 and a terminal on the timer that signals the timer 90 to begin its countdown. As the timer completes its countdown, it make connection between the battery 86 (thru the microswitch 88) and the solenoid 74. This activates the pull motion on the solenoid 74 shown in FIG. 7*b*.

The solenoid 74 pulls the solenoid slide frame 78 towards it, thus pulling the trigger release bar 72 and trigger catch 76 off of the latch assembly bracket 68 surface that was holding it in place. This allows the trigger arm 70 free motion, which then allows the torsion spring 58 shown in FIG. 5*a*-5*c* to freely drive the hammer 60 against the rotary latch release levers 42*c*. Activating the release levers 42*c* frees the shaft 34 and the piston 32, thus allowing the spring 30 to drive the piston 32 forward and eject the football 10. As the shaft 34 leaves the rotary latch assemblies 42, it also relieves pressure on the microswitch 88, thus removing power to the timer 90 and the solenoid 74. This allows the spring inside the solenoid 74 to return pressure on the trigger release bar 72 in preparation for the next equipment cycle.

As shown in FIGS. 2*a* and 2*b*, the released piston 32 pushes the cup 14 and the football 10 along its axis. As the football 10 moves thru the spin wheels 12 that were holding it in place, the misalignment between the spin wheels 12 and the football 10 axis forces it into a helical spin. The cup 14 is mounted to the piston 32 using a shoulder bolt 15 and thrust bearings 20 which allow it to freely rotate in place around the axis of the piston 32. This allows the football 10 to obtain its helical spin with minimum frictional resistance. The piston 32 motion ends when the shaft 34 reaches the stop bumper 44.

ADVANTAGES

From the description above, a number of advantages of this and other embodiments of my football throwing equipment become evident.

1) Superior energy efficiency allows the user to power the equipment with minimal external energy required. This is evident in two areas.
   a. The propulsion is powered by a very efficient axially aligned spring instead of cantilevered throwing arms, elastic bands, motor driven wheels or pneumatic cylinders as in the previous art. Springs are very efficient at storing and releasing energy, as there is very little energy lost in the compression and decompression. Compared to the spring based cantilever art, an axially aligned spring applies energy almost completely into the motion of the football with little wasted on equipment motion. Prior art using pneumatics and electric motors require significant external power sources that make them impractical for use away from building structures. The axial spring design along with the spiral actuator spring compression method in this invention allows the user to provide all the propulsion energy required with minimal human effort.
   b. The use of an energized triggering mechanism allows energy obtained during the compression stroke to power the release of the latching mechanism. This then lowers the external power requirement to just the energy necessary to power the timing circuitry and solenoid used to activate the triggering mechanism. The design is also such that power is consumed only after spring compression and until football release. This is a clear advantage over prior art that required a high voltage, alternating current power source for operation.
2) An improved helical spin, which is required of a football throw, is produced with reduced complexity and cost. The use of axially misaligned spin wheels and a freely rotating cup as shown in FIGS. 2*a*, 2*b* and 3 will produce a consistent and predictable spin with minimal complexity, energy, equipment weight or cost. Previous attempts to induce a helical spin on a football required the use of complex and expensive mechanical assemblies or relied on centrifugal force and friction which produced unpredictable and inconsistent performance.
3) The simplicity of this invention allows for smaller, lighter equipment ideal for rapid transport to the place of use and use by persons of less than adult strength and height.

CONCLUSIONS, RAMIFICATIONS, AND SCOPE OF INVENTION

Accordingly, the reader will see that the embodiment described is an improvement in many ways over the prior art. The use of an axially aligned spring and the spiral actuator arrangement requires a minimal amount of energy to prepare the equipment to propel the football. The energized triggering mechanism reduces the external power required, allowing equipment control using only portable battery power. Additionally, the method of producing the helical spin required on a football is inexpensive, efficient and effective. The efficient design, compact size and limited complexity of the equipment allows it to be easily transported, set up and operated even by persons of less than adult size and strength.

Although the invention has been shown with certain specific embodiments, it will be readily apparent to those skilled in the art that various changes in form and arrangement of parts may be made to suit requirements without departing from the spirit and scope of the invention. For example, the solenoid triggering mechanism shown in FIGS. 5*a*-5*c*, 6 and 7*a*-7*b* could be accomplished by using rotary solenoids, linear actuators or other suitable means of actuating the latching mechanism. Also, the latching mechanism could be released directly using a larger solenoid or a solenoid arranged to obtain greater mechanical leverage on the latching mechanism. The latching mechanism could also be released with a linear actuator or other method that achieved the same result as the triggering mechanism described in this embodiment. An alternative latching mechanism requiring a lower activation force could also be used in place of the rotary latches shown in this embodiment.

The electric timer could be replaced with a mechanical timer and a mechanical timer could be used replicate the action of the solenoid, thus eliminating the need for the battery entirely.

Other embodiments may substitute the manually operated rotational motion during the compression and return stroke with a motor and worm gearing or other suitable mechanical arrangement that produces the torque required. This obviously would require a larger battery, but the compression stroke itself would be achieved using battery power instead of human effort.

Other embodiments of this invention may include additional features such as dampers to slow the return of the handle to its original position in case a user were to let go of the handle during mid compression stroke. Other features may include additional sensors to ensure the football is present before starting the launch cycle or to ensure the handle has returned to its original position before releasing the football. Alarm, buzzers and other audible devices may be added to announce the equipment status (loaded/released, etc.) to nearby people. It is expected that other embodiments of this invention will include an adjustable vertical angling mechanism to achieve higher or lower trajectories as well as wheels and other means to provide portability.

Other embodiments may substitute materials including painted or coated steel (for cost reduction), hardened steel (for strength), stainless steel (for strength and environmental resistance) and plastics (for reduced cost and/or improved appearance).

Batteries of various sizes and compositions can be used, including rechargeable and removable batteries. Other embodiments may include mechanisms to adjust the spin wheel size or location to accommodate the various sizes of footballs in use.

Accordingly, the scope of the invention should be determined not by the embodiment illustrated, but by the appended claims and their legal equivalents.

I claim:

1. An apparatus for throwing a football or football shaped object comprising:

a) a compression spring aligned substantially with the axis of said football to provide the propulsion power necessary to throw said football, b) a means for compressing said spring to the degree necessary to achieve the desired throw distance, said compressing means including a spiral shaped actuator or actuators that, when rotated through a compression stroke, compresses said spring in such a manner that the external force or torque applied to said actuator remains substantially constant throughout said spring compression stroke, c) a means for latching or holding said spring in its compressed state, d) a means for controlling the release of said spring from its latched or compressed state, and e) a means of positioning said football so the motion created by the decompressing spring is transferred to an axial motion in said football.

2. The apparatus of claim 1, further including a trigger mechanism comprising a means of releasing said latching mechanism by a) storing mechanical energy for the purpose of later releasing said latching mechanism and b) having a mechanism whereby said mechanical energy is obtained by the motion of said mechanism occurring during said spring compression and c) having a mechanism for releasing said stored mechanical energy to activate the release function of said latching mechanism.

3. The trigger mechanism of claim 2 wherein a torsion spring is employed to store said mechanical energy.

4. The trigger mechanism of claim 2 further including a means of releasing said stored mechanical energy using a) a solenoid to provide the force necessary to release said stored mechanical energy and b) a battery to provide the power necessary to operated said solenoid and c) a timer to delay the signal to said solenoid whereby an operator can delay the equipment while they get in position to catch said football.

5. The apparatus of claim 1 further including one or more rotary latches for the purpose of restraining said spring in its compressed state.

6. The apparatus of claim 1 further including a threaded device mounted against one end of the spring that can be threaded in or out to change the amount of compression in said spring in order to adjust said throw distance.

7. The apparatus of claim 1 further including a means of releasing said latch mechanism using a) a solenoid to provide the force necessary and b) a battery to provide the power necessary to operate said solenoid and c) a timer to delay the signal to said solenoid whereby an operator can delay the equipment while they get in position to catch said football.

8. An apparatus for throwing a football or football shaped object comprising:

a) a compression spring aligned substantially with the axis of said football to provide the propulsion power necessary to throw said football, b) a means for compressing said spring to the degree necessary to achieve the desired throw distance, c) a means for latching or holding said spring in its compressed state, d) a means for controlling the release of said spring from its latched or compressed state, said release means including a trigger mechanism that is adapted to store mechanical energy for the purpose of later releasing said latching means, said mechanical energy obtained by the motion occurring during compression of said spring, said trigger mechanism having means for releasing said stored mechanical energy to thereby activate the release function of said latching mechanism, and e) a means of positioning said football so the motion created by the decompressing spring is transferred to an axial motion in said football.

9. The apparatus of claim 8 further including a spiral shaped actuator or actuators that compress said spring in such a manner that the external force or torque applied to said actuator remains substantially constant during the compression of said spring.

10. The apparatus of claim 8 wherein a torsion spring is employed to store said mechanical energy.

11. The apparatus of claim 8 further including a means of releasing said stored mechanical energy using a solenoid to provide the necessary release force, a battery to provide the power necessary to operate the solenoid, and a timer to delay the signal to said solenoid whereby an operator can delay the release while he gets in position to catch said football.

12. The apparatus of claim 8 further including one or more rotary latches for the purpose of restraining said spring in its compressed state.

13. The apparatus of claim 8 further including a threaded device mounted against one end of the spring that can be threaded in or out to change the amount of compression in said spring in order to adjust said throw distance.

14. An apparatus for throwing a football or football shaped object comprising:

a) a compression spring aligned substantially with the axis of said football to provide the propulsion power necessary to throw said football, b) a means for compressing said spring to the degree necessary to achieve the desired throw distance, c) at least one rotary latch for restraining said spring in its compressed state, d) a means for controlling the release of said spring from its latched or compressed state, and e) a means of positioning said football so the motion created by the decompressing spring is transferred to an axial motion in said football.

15. The apparatus of claim 14 further including a spiral shaped actuator or actuators that compress said spring in such a manner that the external force or torque applied to said actuator remains substantially constant during the compression of said spring.

16. The apparatus of claim 14 further including a trigger mechanism having a means for releasing said rotary latch by storing mechanical energy for the purpose of later releasing the latch, the trigger mechanism having means to obtain said mechanical energy by the motion occurring during said spring compression action, and having a mechanism for releasing said stored mechanical energy to thereby activate the latch release function.

17. The apparatus of claim 16 wherein a torsion spring is employed to store said mechanical energy.

18. The apparatus of claim 16 wherein said trigger mechanism includes a solenoid to provide the necessary release force, a battery to provide the power necessary to operate the solenoid, and a timer to delay the signal to said solenoid.

19. The apparatus of claim 14 further including a threaded device mounted against one end of the spring that can be threaded in or out to change the amount of compression in said spring in order to adjust said throw distance.

20. The apparatus of claim 14 further including a means of releasing said rotary latch, said release means comprising a solenoid to provide the necessary release force, a battery to provide the power necessary to operate the solenoid, and a timer to delay the signal to said solenoid whereby an operator can delay the release while he gets in position to catch said football.

* * * * *